United States Patent [19]

Deubel et al.

[11] 4,091,354

[45] May 23, 1978

[54] BIMETAL SNAP DISC THERMOSTAT ARRANGED TO REDUCE TEMPERATURE CALIBRATION DRIFT

[75] Inventors: Bernard S. Deubel; Donald J. Schmitt, both of Mansfield, Ohio

[73] Assignee: Therm-O-Disc Incorporated, Mansfield, Ohio

[21] Appl. No.: 692,591

[22] Filed: Jun. 3, 1976

[51] Int. Cl.[2] ..... H01H 37/74

[52] U.S. Cl. ..... 337/343; 337/365; 337/380

[58] Field of Search ..... 337/343, 347, 354, 363, 337/365, 368, 380; 73/378.3; 335/188

[56] References Cited

U.S. PATENT DOCUMENTS

| | | | |
|---|---|---|---|
| 3,297,845 | 1/1957 | Mertler | 337/380 |
| 3,718,880 | 2/1973 | Pringle et al. | 337/380 |
| 3,832,667 | 8/1974 | Blanton | 337/368 |

*Primary Examiner*—George Harris

*Attorney, Agent, or Firm*—McNenny, Pearne, Gordon, Gail, Dickinson & Schiller

[57] ABSTRACT

A bimetal snap disc thermostat is disclosed in which a steel disc cup is provided for strength and/or environmental resistant properties. Positioned within the disc cup is a disc seat formed of aluminum. A bimetal snap disc is positioned in the disc seat and operates the thermostat switch through an axially movable bumper. A ring of rubber like foam material is positioned between the body assembly and the disc on the side of the disc remote from the disc seat. The aluminum disc seat reduces temperature calibration drift of the disc during the cycling of the disc which occurs during the use of the thermostat. The foam ring also tends to reduce bouncing and thereby tends to reduce temperature calibration drift. Also the ring functions to insure that the disc remains properly seated in its aluminum disc seat.

7 Claims, 2 Drawing Figures

Fig. 1
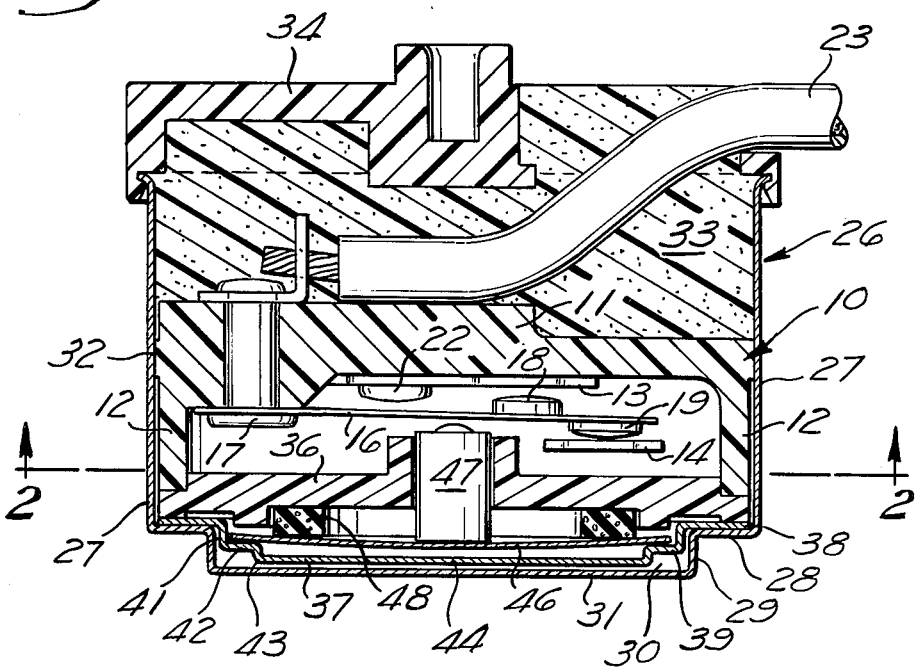
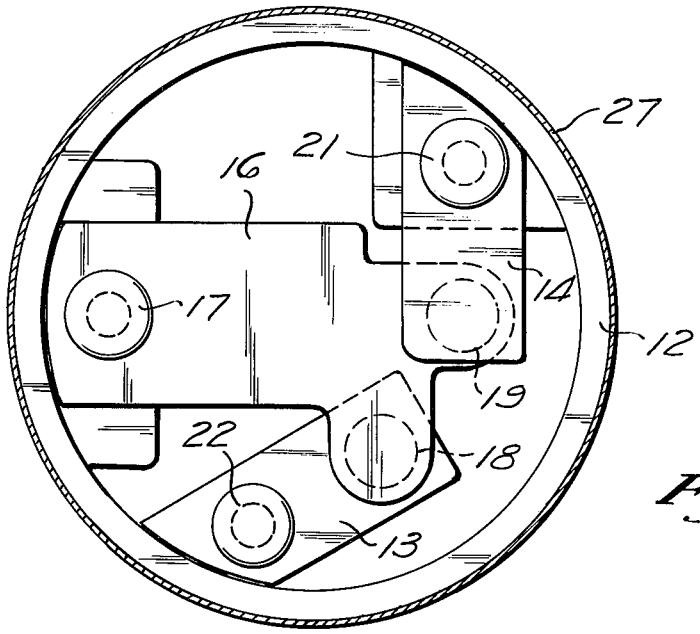
Fig. 2

BIMETAL SNAP DISC THERMOSTAT ARRANGED TO REDUCE TEMPERATURE CALIBRATION DRIFT

BACKGROUND OF THE INVENTION

This invention relates generally to thermostats employing bimetal snap disc operators and more particularly to a thermostat of such type constructed to reduce temperature drift.

PRIOR ART

Bimetal snap disc thermostats typically operate at a calibration or disc operating temperature determined by the material of the disc and the shape of the disc established during the manufacture thereof.

When a disc cycles during use of the device there is a tendency in some instances for the operating temperature of the disc to change or drift from the original calibration temperature. It is believed that such calibration or temperature drift occurs when the mounting of the disc is such that excessive disc impacting and bouncing occurs when the disc snaps.

It is known to reduce the temperature drift by providing a spring bias to the disc to limit the bouncing of the disc within the mounting clearance. Such spring bias may also be used to adjust the operating temperature as described in the U.S. Pat. No. 3,573,700 dated Apr. 6, 1971. It is also known to provide a foam rubber ring against one disc face to apply a light spring force to reduce the bouncing and reduce the temperature drift. It is also known to form the disc cup from aluminum and that the problem of temperature drift is not as severe with aluminum disc cups as when the disc is seated against steel.

SUMMARY OF THE INVENTION

In accordance with the present invention a novel and improved bimetal snap disc thermostat is provided in which a steel disc cup is combined with a disc seat formed of a material having a substantially lower modulus of elasticity than the steel to reduce the tendency for temperature drift. In such device the steel cup is used for greater strength or its environmental resistance properties and the disc itself is protected from excessive impacting and bouncing to minimize temperature drift by the disc seat having a substantially lower modulus of elasticity than steel. In the illustrated embodiment the disc seat is aluminum. Such disc seat is arranged to reduce bounce while providing a good heat conductive path between the disc cup and the disc for good temperature response. Further the disc seat is shaped to insure proper disc seat position and for ease of assembly. Also a foam rubber ring is illustrated on the side of the disc opposite the disc seat to further reduce the tendency for temperature drift and to insure that the disc remains properly positioned within the seat.

BRIEF DESCRIPTION OF THE DRAWINGS

FIG. 1 is a side elevation in cross section illustrating a sealed thermostat incorporated in the present invention;

FIG. 2 is a view taken generally along 2—2 of FIG. 1 illustrating the arrangement of the switch;

DETAILED DESCRIPTION OF THE DRAWINGS

The illustrated embodiment of this invention includes a switch body 10 which is preferably molded of the phenolic material and provides an end wall 11 and a generally cylindrical skirt 12 extending axially therefrom. Mounted on the switch body 10 is a double throw single-pole switch assembly including a first fixed contact 13 and a second fixed contact 14. A movable contact support arm 16 is supported at one end by a terminal rivet 17 and is provided with a movable contact 18 movable into and out of engagement with the fixed contact 13 and a second movable contact 19 which is movable into and out of engagement with the fixed contact 14. In the illustrated position the movable contact 19 is closed with the fixed contact 14 and when the switch is operated such contacts separate. At the same time movable contact 18 moves into engagement with the fixed contact 13.

The fixed contact 14 is mounted on the switch body 10 by a rivet 21 as illustrated in FIG. 2 and the fixed contact 13 is mounted on the switch body by a rivet 22. Connected to the various rivets are leads such as lead 23 which is connected to the terminal rivet 17. The leads connecting the terminal rivets 21 and 22 do not appear in the drawing since they do not appear in the section of FIG. 1.

The switch body 11 is mounted within a disc retaining cup 26 formed of steel or other similar high strength material. Such disc cup includes a cylindrical side wall 27 which extends from the open end thereof to a radially extending shoulder 28 extending inwardly from the side wall 27 to a cylindrical wall portion 29. A central end wall portion 31 cooperates with the shoulder 28 and cylindrical wall portion 29 to provide an imperforate end wall of the cup 26 having a central recess 30.

In the illustrated embodiment the switch body 10 is provided with a peripheral rib 32 which fits into the cup with a press fit and the zone within the cup above the switch body is filled with a potting material 33 such as epoxy so that the switch body is securely maintained in the proper position and so that a seal is provided between the disc cup and the switch body. Also the potting material surrounds the ends of the leads providing insulation between the ends of the leads and also protecting the leads. A mounting cover 34 is secured to the open end of the disc cup and is also retained by the potting material 33.

Positioned within the disc cup below the disc body 10 is a disc shield 36 which is also preferably molded from a phenolic material. Below the disc shield within the disc cup is a disc seat 37 formed of a material having a modulus of elasticity substantially lower than the modulus of the elasticity of steel. Such disc seat member 37 in the illustrated embodiment is formed of aluminum. The disc seat member 37 provides a peripheral flange 38 proportioned to closely fit the cylindrical wall 27 of the disc cup and to seat against the shoulder 28 of the disc cup. Inwardly of the flange 38 the disc seat member 37 is formed with a stepped seat 39 provided by a cylindrical section 41 and a radial section 42. Inwardly of the radial section 42 is a second step at 43 and an end wall at 44. The step at 43 offsets the end wall 44 so that a bimetal snap disc 46 is provided with clearance along the central section thereof.

The bimetal snap disc 46 is provided with a shallow disked shape so that the disc snaps from one position of stability to another position of stability upon reaching predetermined calibration temperatures. The calibration temperature of the disc is determined by the material used to form the disc and the shape provided in the disc during its manufacture.

A bumper 47 extends between the central portion of the snap disc 46 and the movable contact support arm 16 and is guided within the disc shield 36. When the snap disc is in a position of stability illustrated in FIG. 1 the bumper allows the movable contact support arm 16 to move to the position illustrated in which the movable contact 19 is in engagement with the fixed contact 14. When the disc 46 snaps through to its opposite position of stability the bumper 47 is moved toward the switch contact support arm 16 and causes such arm to flex to its opposite switch condition in which the movable contact 18 is in engagement with the fixed contact 13. Preferably the elements are proportioned so that the bumper 47 has a length slightly less than the spacing between the center portion of the disc 46 and the movable contact support arm 16 when the disc is in the position of stability illustrated. This provides lost motion to insure that the switch does not operate until after the disc is in snap movement.

In the illustrated embodiment an annular spring ring 48 is positioned between the disc shield 36 and the adjacent side of the snap disc 46. Such ring functions to provide some damping action tending to reduce the bouncing of the disc when it operates and also functions to insure that the periphery of the disc 46 remains in the disc seat 39. Such ring 48 is formed of an elastomeric or rubber like foam material which cooperates with the disc seat to reduce temperature calibration drift during the cycling of the disc. However, the principal structure for reducing temperature drift is provided by the disc seat 39 which has a substantially lower modulus of elasticity than the steel disc cup. Such seat limits and cushions the impact and also provides a surface against which excessive bouncing does not occur. It has been found that the use of an aluminum disc seat can in some instances reduce calibration drift by substantially more than 50% when compared to a comparable structure utilizing a steel disc seat.

In the illustrated embodiment the offset of the central wall 44 of the disc seat is slightly less than the offset recess provided in the disc cup to insure that the flange 38 is seated against the shoulder 28 and the disc cup during assembly. With this structure the device is properly gauged and provided with a bumper having the required length. The switch body 10 is then pressed to the disc cup until the various elements bottom out. When this occurs the proper spacing is provided between the disc 46 and the switch mechanism.

The flange 38 is sized to closely fit the side walls 27 of the disc cup to insure proper radial positioning of the disc seat within the cup. Here, again a slight clearance is provided between the cylindrical wall 41 of the disc seat and the cylindrical wall 29 of the disc cup 26 to insure that the disc seat does not bind before it reaches the proper position within the cup.

With the structure illustrated it is a simple matter to insert the disc seat in the disc cup during the manufacture and to be sure that the disc seat is properly positioned within the cup. It is only necessary to insure that the disc seat is not inserted in the cup upside down and, of course, such improper assembly is easily noticeable. During assembly it is merely necessary therefore to insure that the disc seat is rightside up and to drop the disc seat into the disc cup. When this is done the disc seat is automatically properly positioned within the disc cup.

Although the illustrated embodiment of this invention is illustrated with an elastomeric foam ring 48 positioned between the disc shield 36 and the disc such ring is not necessary in accordance with the broader aspects of the present invention and substantial reductions and calibration temperature drift are achieved with the aluminum disc seat itself compared to disc seats formed of steel or the like. It should also be understood that the aluminum disc seat because of its relatively good thermal conductivity does not materially reduce the temperature sensitivity of the device.

In accordance with the broader aspects of this invention the disc seat may be formed of other materials so long as they provide a relatively low modulus of elasticity when compared to steel and so long as they have sufficient stability and strength to withstand the high impacts which occur during the snapping of the disc without damage to the disc and without damage to the seat.

Although a preferred embodiment of this invention is illustrated it is to be understood that various modifications and rearrangements may be resorted to without departing from the scope of the invention disclosed and claimed.

What is claimed is:

1. A bimetal snap disc thermostat comprising a body assembly, a switch mounted on said body assembly, a steel or the like disc cup mounted on said body assembly and cooperating therewith to define a disc chamber, a seat member positioned within said disc cup providing a disc seat for supporting a bimetal snap disc adjacent its periphery, and a bimetal snap disc seated on said disc seat and connected to operate said switch with snap action upon reaching predetermined operating temperatures, said disc seat being formed of material having a substantially lower modulus of elasticity than the steel of said cup, said disc seat being formed of aluminum and provides a radial portion positioned between and axially located by said disc cup and said body assembly, said radial portion engaging said disc cup over a substantial area.

2. A bimetal snap disc thermostat as set forth in claim 1 wherein spring means resiliently urged said disc to engagement with said disc seat.

3. A bimetal snap disc thermostat as set forth in claim 2 wherein said resilient means is an annular ring formed of foam elastomeric material positioned between body assembly and the side of snap disc remote from said disc seat.

4. A bimetal snap disc thermostat as set forth in claim 1 wherein said disc cup is formed with an end wall providing a central recess, and said disc seat is positioned within said recess with clearance.

5. A bimetal snap disc thermostat as set forth in claim 1 wherein said disc seat portion is a peripheral flange seated against a peripheral shoulder in said disc cup.

6. A bimetal snap disc thermostat as set forth in claim 1 wherein said disc cup and disc seat are shaped so that said disc seat is radially located within said disc cup by the side walls of said disc cup.

7. A bimetal snap disc thermostat comprising a switch body, a switch mounted on said body, a steel or the like disc cup press fitted on to said body and cooperating therewith to define a sealed disc chamber, said disc cup providing a side wall and an end wall, said end wall having a radially extending peripheral shoulder extending inwardly from said side wall to a generally cylindrical wall which in turn extends axially to a radially extending central wall portion, said cylindrical wall and said central wall portion cooperating to define a central recess within said end wall, an aluminum disc seat positioned against said end wall, said disc seat providing a peripheral flange engaging said peripheral shoulder and cooperating with said side wall and peripheral shoulder to radially and axially locate said disc seat within said disc cup, said disc seat providing a stepped seat located within said central recess, a bimetal snap disc positioned within said stepped seat radially and axially located thereby, and an operator between said disc and switch operating said switch in response to snap movement of said disc.

* * * * *